US010455680B2

(12) United States Patent
Vaschenko et al.

(10) Patent No.: US 10,455,680 B2
(45) Date of Patent: Oct. 22, 2019

(54) METHOD AND APPARATUS FOR PURIFYING TARGET MATERIAL FOR EUV LIGHT SOURCE

(71) Applicant: ASML Netherlands B.V., Veldhoven (NL)

(72) Inventors: Georgiy Vaschenko, San Diego, CA (US); Peter Baumgart, San Diego, CA (US); Chirag Rajyaguru, San Diego, CA (US); Benjamin Sams, San Diego, CA (US); Armin Ridinger, San Diego, CA (US); Janine Kardokus, San Diego, CA (US)

(73) Assignee: ASML NETHERLANDS B.V., Veldhoven (NL)

( * ) Notice: Subject to any disclaimer, the term of this patent is extended or adjusted under 35 U.S.C. 154(b) by 608 days.

(21) Appl. No.: 15/057,086

(22) Filed: Feb. 29, 2016

(65) Prior Publication Data

US 2017/0247778 A1 Aug. 31, 2017

(51) Int. Cl.
*C22B 3/00* (2006.01)
*H05G 2/00* (2006.01)
(Continued)

(52) U.S. Cl.
CPC ..... *H05G 2/008* (2013.01); *C22B 9/04* (2013.01); *C22B 25/08* (2013.01); *F27B 17/00* (2013.01); *F27B 17/02* (2013.01); *H05G 2/005* (2013.01)

(58) Field of Classification Search
CPC . C22B 25/08; C22B 9/04; F27B 17/00; F27B 17/02; H05G 2/005; H05G 2/008
(Continued)

(56) References Cited

U.S. PATENT DOCUMENTS 3,314,670 A 4/1967 Kennedy
3,845,807 A 11/1974 Koon
(Continued)

FOREIGN PATENT DOCUMENTS

CN 104263969 A 1/2015
WO 9212108 A1 7/1992

OTHER PUBLICATIONS

Maehara, T. & Laimbock, P., "Behaviour of oxygen in the tin bath used in float glass production," Glass Technol. Eur J. Glass Sci. Technol. A, vol. 53, No. 6, pp. 261-272 (Dec. 2012).
(Continued)

*Primary Examiner* — Scott R Kastler
*Assistant Examiner* — Michael Aboagye
(74) *Attorney, Agent, or Firm* — Arent Fox LLP

(57) ABSTRACT

A deoxidation system for purifying target material for an EUV light source includes a furnace having a central region and a heater for heating the central region in a uniform manner. A vessel is inserted in the central region of the furnace, and a crucible is disposed within the vessel. A closure device covers an open end of the vessel to form a seal having vacuum and pressure capability. The system also includes a gas input tube, a gas exhaust tube, and a vacuum port. A gas supply network is coupled in flow communication with an end of the gas input tube and a gas supply network is coupled in flow communication with an end of the gas exhaust tube. A vacuum network is coupled in flow communication with one end of the vacuum port. A method and apparatus for purifying target material also are described.

17 Claims, 3 Drawing Sheets

(51) Int. Cl.

| | |
|---|---|
| ***C22B 9/04*** | (2006.01) |
| ***C22B 25/08*** | (2006.01) |
| ***F27B 17/00*** | (2006.01) |
| ***F27B 17/02*** | (2006.01) |

(58) Field of Classification Search
USPC ..... 266/210
See application file for complete search history.

(56) References Cited

U.S. PATENT DOCUMENTS

| | | | | |
|---|---|---|---|---|
| 3,873,073 | A | 3/1975 | Baum et al. | |
| 4,396,824 | A | 8/1983 | Fiegl et al. | |
| 4,946,542 | A | 8/1990 | Clemans | |
| 5,143,355 | A * | 9/1992 | Iwamura | C22B 15/005 164/473 |
| 5,736,096 | A | 4/1998 | Otsuka et al. | |
| 7,419,545 | B2 * | 9/2008 | Kitaoka | C30B 9/00 117/13 |
| 7,541,586 | B2 * | 6/2009 | Miller | G01N 21/39 250/339.07 |
| 8,001,853 | B2 | 8/2011 | Pratt | |
| 8,257,492 | B2 * | 9/2012 | Hoshino | C01B 33/037 117/11 |
| 8,461,487 | B2 * | 6/2013 | Hoshino | C01B 33/037 219/383 |
| 8,581,220 | B2 | 11/2013 | Ishihara et al. | |
| 2002/0129622 | A1 | 9/2002 | Giacobbe | |
| 2009/0025885 | A1 | 1/2009 | Buschbeck et al. | |
| 2011/0114012 | A1 | 5/2011 | Hoshino et al. | |
| 2014/0248708 | A1 | 9/2014 | Coleman et al. | |

OTHER PUBLICATIONS

Bolind, A. M., Shivprasad, A. P., Frazer, D. & Hosemann, P., "Essential aspects of controlling the oxygen content of molten tin in engineering applications," Materials and Design, vol. 52, pp. 168-178 (2013).

H. Pops, "The Metallurgy of Copper Wire; Copper Applications in Metallurgy of Copper & Copper Alloys," Innovations [Retrieved from the Internet: Mar. 15, 2017] <URL: https://www.copper.org/publications/newsletters/innovations/1997/12/ wiremetallurgy.html> Dec. 1997 (7 total pages).

Notification of Transmittal of International Search Report and Written Opinion issued in International Application No. PCT/US17/17240, dated Apr. 14, 2017 (14 total pages).

* cited by examiner

METHOD AND APPARATUS FOR PURIFYING TARGET MATERIAL FOR EUV LIGHT SOURCE

BACKGROUND

In an extreme ultraviolet (EUV) light source, a droplet generator is used to deliver 10-50 μm droplets of target material, e.g., molten tin, to the focus of the EUV light collecting optics where the droplets are irradiated with laser pulses, thus creating a plasma that produces EUV light. The droplet generator includes a reservoir that holds the molten tin, a nozzle with a micron-sized orifice, and an actuator to drive droplet formation. High purity tin (e.g., 99.999-99.99999% pure) must be used in the droplet generator as even a ppm-level of contamination with certain impurities can lead to the formation of solid particles of a tin compound that are capable of clogging the nozzle and thereby causing the EUV light source to fail.

The purification processes typically used by suppliers for production of tin are generally quite effective for removing impurities formed by chemical elements, e.g., metallic impurities. Such purification processes, however, are not specifically formulated to remove oxygen from tin as oxygen is typically acceptable in most applications of high purity metals. Commercially pure tin contains oxygen at a concentration that significantly (at least about 1,000 times) exceeds the solubility limit of oxygen just above the melting point of tin. Consequently, tin oxide particles are readily formed and, in some instances, cause blocking of the nozzle orifice and in turn failure of the droplet generator and the EUV light source.

It is in this context that embodiments arise.

SUMMARY

In an example embodiment, a system includes a furnace having a central region defined therein. The furnace has at least one heater configured to heat the central region thereof in a substantially uniform manner. A vessel has an open end for loading, such that when inserted in the central region of the furnace, the open end of the vessel is located outside of the furnace. A crucible having an open end is disposed within the vessel. The crucible is disposed within the vessel such that the open end of the crucible faces the open end of the vessel. A closure device covers the open end of the vessel. The closure device is configured to form a seal having vacuum and pressure capability.

The system also includes a gas input tube, a gas exhaust tube, and a vacuum port. The gas input tube has a first end located outside the vessel and a second end located inside the vessel. The second end of the gas input tube is positioned such that an input gas flowing into the vessel is directed into the crucible. The gas exhaust tube has a first end located outside the vessel and a second end in flow communication with the inside of the vessel. The vacuum port has a first end located outside the vessel and a second end in flow communication with the inside of the vessel.

The system further includes a gas supply network, a gas exhaust network, and a vacuum network. The gas supply network is coupled in flow communication with the first end of the gas input tube and the gas supply network is coupled in flow communication with the first end of the gas exhaust tube. The vacuum network is coupled in flow communication with the first end of the vacuum port.

In one example, the vessel is a metal vessel. In one example, the metal vessel is formed of stainless steel or an alloy steel. In one example, an outer surface of the vessel is coated with an oxidation-resistant material.

In one example, the gas supply network includes a gas supply containing hydrogen and a gas purifier. In one example, the gas supply contains a gas mixture of argon and hydrogen. In one example, the gas mixture of argon and hydrogen includes up to 2.93 molar % hydrogen and the balance substantially argon.

In one example, the gas exhaust network includes at least one flow controller and a spectrometer. In one example, the spectrometer is a cavity ring-down spectrometer (CRDS). In one example, the vacuum network includes at least one vacuum generating device capable of generating high vacuum and at least one vacuum gauge.

In another example embodiment, a method includes loading a target material in a crucible, with the target material to be used in a droplet generator of an extreme ultraviolet (EUV) light source. The method also includes inserting the loaded crucible into a vessel and sealing the vessel, melting the target material in the crucible, flowing a gas containing hydrogen over a free surface of the molten target material, and measuring a concentration of water vapor in the gas exiting the vessel. After the measured concentration of water vapor in the gas exiting the vessel reaches a target condition, the method includes allowing the molten target material to cool.

In one example, the target condition includes the measured water vapor concentration in the gas exiting the vessel stabilizing at a minimum level. In one example, the target condition indicates a predetermined concentration of oxygen in the target material. In one example, the target condition indicates a predetermined concentration of oxygen in the target material that is less than 100 times the solubility limit of oxygen in the molten target material. In other examples, the target condition indicates a predetermined concentration of oxygen in the target material that is less than 10 times the solubility limit of oxygen in the molten target material.

In one example, the target material is high purity tin. In one example, the gas containing hydrogen is a gas mixture including up to 2.93 molar % of hydrogen and the balance substantially argon.

In one example, the operation of melting the target material in the crucible includes generating a vacuum within the vessel, once an effective vacuum condition is obtained within the vessel, heating the vessel from room temperature to about 500 degrees C., and maintaining the temperature at about 500 degrees C. until the target material melts.

In one example, the operation of flowing a gas containing hydrogen over a free surface of the molten target material includes orienting the crucible at an angle relative to a horizontal plane to increase a free surface area of the molten target material, and increasing the temperature within the vessel from about 500 degrees C. to about 750 degrees C. as the hydrogen-containing gas flows over the free surface of the molten target material. In one example, the crucible is oriented at an angle of about 12 degrees relative to the horizontal plane.

In one example, the operation of allowing the target material to cool includes turning off heaters heating the vessel while maintaining flow of the gas containing hydrogen, allowing the vessel to cool from about 750 degrees C. down to about room temperature, and after the temperature cools down to about room temperature, stopping the flow of the hydrogen-containing gas and depressurizing the vessel. In one example, the vessel is allowed to cool naturally. In another example, the operation of allowing the vessel to cool includes using forced cooling to cool the vessel.

In yet another example embodiment, an apparatus includes a metal vessel having an open end and a closed end, with the metal vessel having a cylindrical shape. A crucible is disposed within the metal vessel. The crucible, which has an open end and a closed end, is disposed within the metal vessel such that the open end of the crucible faces the open end of the metal vessel. A closure device covers the open end of the metal vessel, with the closure device being configured to form a seal having vacuum and pressure capability. An input tube has a first end located outside the vessel and a second end located inside the vessel. The second end of the input tube is positioned to direct an input gas flowing into the vessel through the input tube toward the crucible. An exhaust tube has a first end located outside the metal vessel and a second end in flow communication with the inside of the metal vessel.

In one example, the metal vessel is formed of stainless steel or an alloy steel. In one example, the crucible is a quartz crucible purified and cleaned to a level compatible with compound semiconductor crystal growth. In one example, the crucible is formed of carbon coated quartz, glassy carbon, graphite, glassy carbon coated graphite, or SiC-coated graphite.

In one example, a sidewall of the crucible has a tapered shape that facilitates removal of an ingot from the crucible. In one example, the input tube is a metal tube or a glass tube. In one example, the input tube is a ceramic tube or a graphite tube. In one example, the apparatus further includes a vacuum port defined in a wall of the metal vessel.

Other aspects and advantages of the disclosures herein will become apparent from the following detailed description, taken in conjunction with the accompanying drawings, which illustrate by way of example the principles of the disclosures.

DETAILED DESCRIPTION

In the following description, numerous specific details are set forth in order to provide a thorough understanding of the example embodiments. However, it will be apparent to one skilled in the art that the example embodiments may be practiced without some of these specific details. In other instances, process operations and implementation details have not been described in detail, if already well known.

To mitigate nozzle clogging by metal oxide particles in droplet generators used in extreme ultraviolet (EUV) light sources, an additional operation in the process of purifying the target material is used in which oxygen is removed from the target material. Broadly speaking, this deoxidation operation can be implemented by heating the target material to a high temperature (e.g., 600 degrees C. to 900 degrees C.) and flowing a hydrogen (or a hydrogen-containing inert gas) over the surface of the molten target material so that the target material can react with the hydrogen and form water vapor, which is carried away by the gas flow. Additional details regarding EUV light sources in which droplet generators are used can be found in U.S. Pat. Nos. 8,653,491 B2 and 8,138,487 B2, the disclosures of which are incorporated by reference herein for all purposes.

Figure 1:
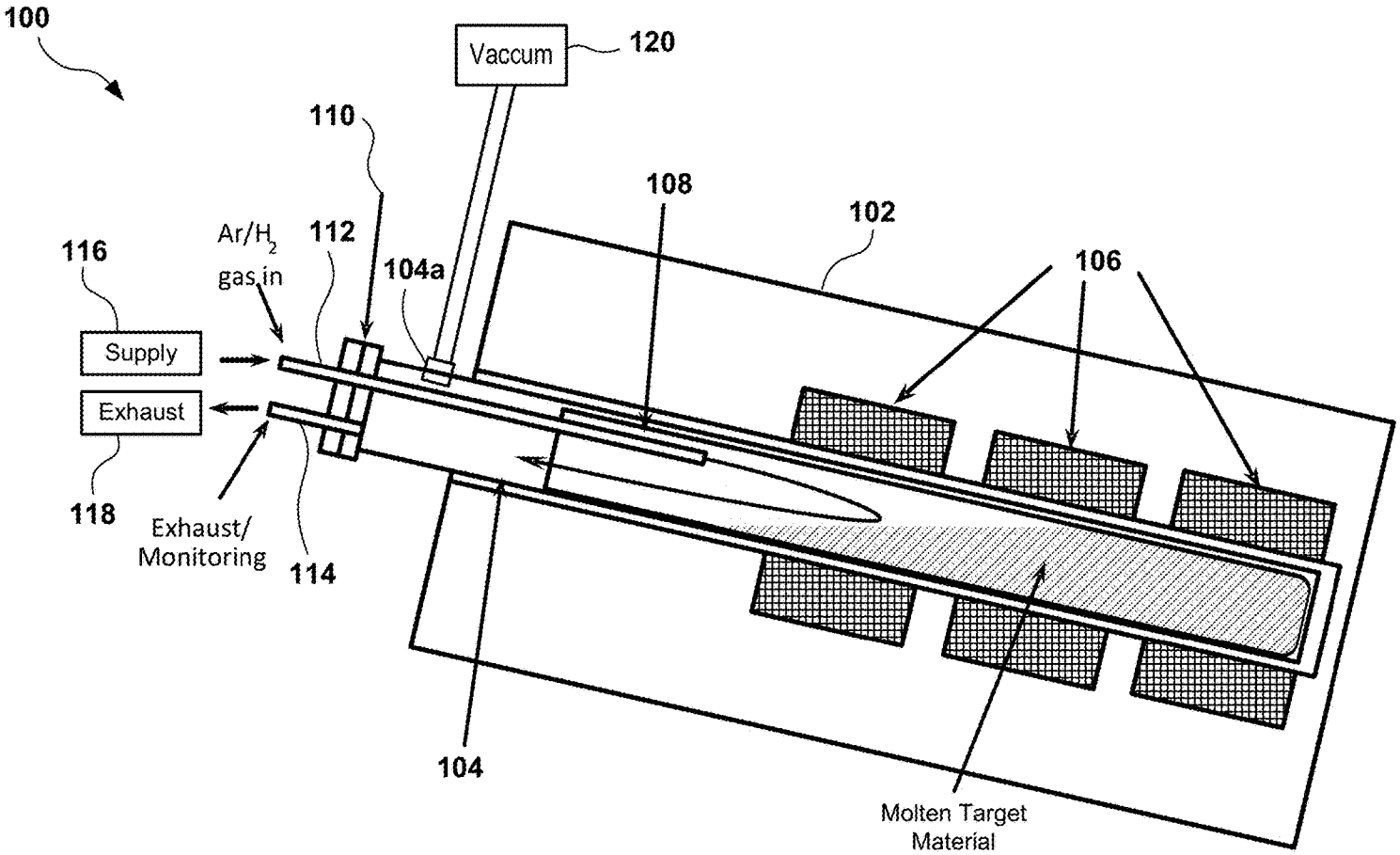
FIG. 1 is a simplified schematic diagram of a target material deoxidation system, in accordance with an example embodiment.

FIG. 1 is a simplified schematic diagram of a target material deoxidation system, in accordance with an example embodiment. As shown in FIG. 1, deoxidation system 100 includes a furnace 102 having a central opening that defines a central region in which a vessel 104 is disposed. In one example, the vessel 104 is a metal vessel that has both vacuum and high pressure capability at elevated temperatures, e.g., a stainless steel vessel, an alloy steel vessel, etc. In one specific example, the metal vessel is formed of type 304 stainless steel, which has high temperature compatibility, strength at high temperature, and hydrogen compatibility. In one example, the inner surface of the vessel 104 is electropolished to reduce outgassing. In addition, the vessel 104 should be made in such a way that minimizes absorption of oxygen on the outer surface of the vessel and the diffusion of oxygen toward the inner surface where it can react with hydrogen and be removed from the inner surface in the form of water molecules. In one example, a coating that inhibits oxidation is provided on the outer surface of the vessel 104. By way of example, the coating can be comprised of materials such as chromium carbide/nickel chromium, iron aluminide, nickel aluminide, amorphous aluminum phosphate, chromia, etc.

The furnace 102 includes one or more heaters 106 that are configured to provide the furnace with well-controlled temperature, well-controlled temperature ramp up, and uniformity of temperature. The heaters 106 can be commercially available heaters. In one example, the heaters are resistive-type electric heaters with wire filaments potted in a ceramic fiber matrix. In one example, the semi-circular heaters are mounted on the furnace tube so that they can be thermally isolated from the furnace frame. The furnace 102 is equipped with forced cooling capability which, by way of example, may be implemented using either air flow or a high temperature compatible fluid. By providing the furnace with forced cooling capability, the cycle time of the target material purification process can be significantly reduced.

With continuing reference to FIG. 1, the target material to be deoxidized is placed in crucible 108. In one example, the target material is an ultra-high purity material that is pre-purified to at least the 99.999% purity level. The crucible 108 can be made of any suitable material that exhibits high-temperature resistance and is compatible with the target material to be deoxidized. In this regard, the crucible should be capable of maintaining 99.99999% purity. In addition, the high purity crucible should be non-reactive with the target material and cleaned to the ppm impurity level. In one example in which the target material is tin, the crucible 108 is a quartz crucible purified and cleaned to a level compatible with compound semiconductor crystal growth. By way of example, other suitable ceramic materials from which the crucible can be formed include glassy carbon, graphite, glassy carbon coated graphite, carbon coated quartz, SiC-coated graphite, etc. As shown in FIG. 1, the crucible 108 has a cylindrical shape. In one example, the crucible 108 has a slightly tapered shape that facilitates removal of the deoxidized target material ingot from the crucible.

As shown in FIG. 1, the crucible 108 is rotated at an angle relative to the horizontal plane. In one example, the crucible 108 is rotated at an angle of about 12 degrees relative to the horizontal plane. As used herein, the term "about" means that a parameter can be varied by ±10% from the stated amount or value. In this example, the crucible 108 is disposed at an angle of about 12 degrees to maximize the free surface area of the molten target material with the practical volume fill and crucible length limits, thus resulting in faster, more efficient purification of the target material. Those skilled in the art will appreciate that the deoxidation system can be configured to allow the crucible to be rotated at different angles relative to the horizontal plane. By way of example, the crucible 108 may be rotated to maximize free surface area of the target material during the deoxidation process and then rotated vertically to ease handling after the purification process is completed.

To start a deoxidation process, target material that needs to be deoxidized is loaded into the crucible 108 in solid form, e.g., in the form of an ingot. The loaded crucible 108 is then inserted into an open end of vessel 104. Once the crucible 108 is in place within the vessel 104, closure device 110 is secured to the open end of the vessel. The closure device 110 is configured to provide a seal having vacuum and pressure capability at the open end of the vessel 104. The closure device 110 has two openings therein that allow gas to be 1) introduced into the crucible 108, and 2) exhausted from the vessel. As shown in FIG. 1, gas input tube 112 passes through one opening in the closure device 110 and extends into the crucible 108. With this configuration, the input gas can flow over the free surface area of the target material (after the target material has been melted, as will be described in more detail below). In one example, the gas input tube 112 is formed of a suitable metal or ceramic material. The gas exhaust tube 114 is disposed in a second opening in the closure device 110 and thereby enables gas to exit from the vessel 104. The exhaust gas exiting the vessel 104 via the gas exhaust tube 114 can be used to monitor the purification process, as will be described in more detail below.

As shown in FIG. 1, the end of gas input tube 112 situated outside of vessel 104 is coupled in flow communication with gas supply network 116. The end of gas exhaust tube 114 situated outside of vessel 104 is coupled in flow communication with gas exhaust network 118. In addition, vacuum system 120 is coupled in flow communication with the interior of vessel 104 via a port 104*a* defined in a sidewall of the vessel. Additional details regarding gas supply network 116, gas exhaust network 118, and vacuum system 120 are described below with reference to FIG. 2.

In another example, the gas input tube 112 can extend into the molten target material in the crucible 108 so that the input gas can bubble through the target material being purified. In this example, the gas input tube 112 can be formed of, by way of example, a ceramic material, graphite, etc. Introducing the input gas directly into the molten target material not only increases the surface area of the target material in contact with the input gas but also facilitates agitation of the molten target material, thus aiding diffusion with the task of delivering oxygen to the surface of the target material. Those skilled in the art will appreciate that agitation of the molten target material can be accomplished using other techniques. For example, mechanical techniques such as rotating, rocking, or shaking the crucible can be used to agitate the molten target material therein. Agitation can also be accomplished using magnetic, electromagnetic, or electrodynamic stirrers.

Figure 2:
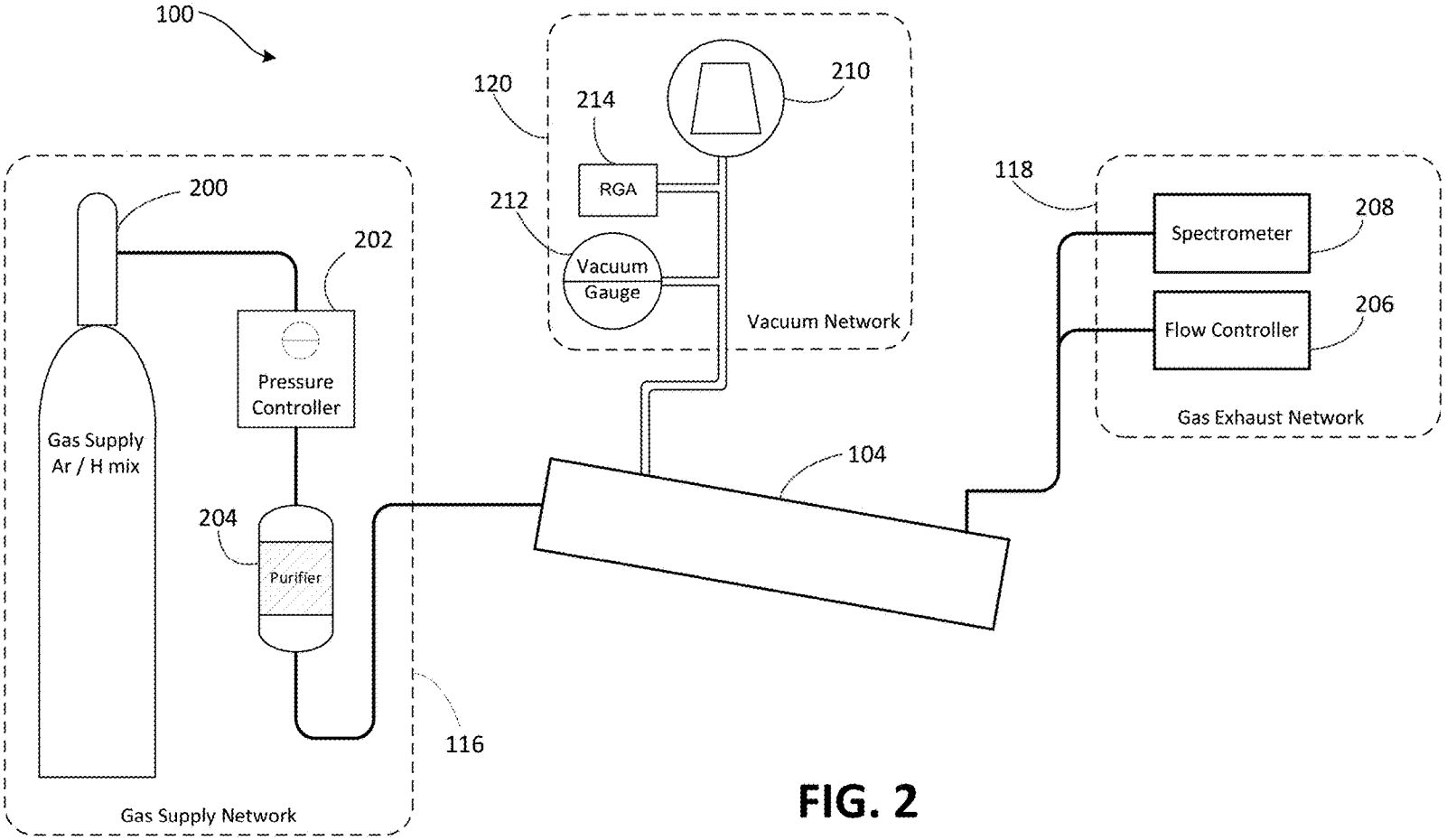
FIG. 2 is a simplified schematic diagram that illustrates the gas and vacuum systems for use in a target material deoxidation system, in accordance with an example embodiment.

FIG. 2 is a simplified schematic diagram that illustrates the gas and vacuum systems for use in a target material deoxidation system, in accordance with an example embodiment. As shown in FIG. 2, input gas is supplied to the vessel 104 of the target material deoxidation system 100 by gas supply network 116. Exhaust gas network 118 handles the exhaust gas exiting from the vessel 104 and vacuum system 120 has the capability to generate a vacuum within the vessel. Additional details regarding the gas supply network 116, the exhaust gas network 118, and the vacuum system 120 are described below.

The gas supply network 116 includes, among other components, gas supply 200, pressure controller 202, and gas purifier 204. The gas supply 200 contains a reducing gas suitable for use in the deoxidation process to be carried out in vessel 104 of the target material deoxidation system 100. In one example in which the target material to be deoxidized is tin, the gas supply may contain pure hydrogen. Those skilled in the art will appreciate that the best efficiency of the deoxidation process would be obtained with the use the greatest reducing gas that does not degrade the equipment. The use of pure hydrogen may present safety issues due to flammability. As such, it may be preferable to use a gas containing a nonflammable gas mix comprised of hydrogen and a buffer gas, which may be an inert gas such as argon. By way of example, the gas mix can include a nonflammable concentration of hydrogen, e.g., up to 2.93 molar %, mixed in argon. The gas mix is processed to remove residual moisture before being used, as will be described in more detail below.

Gas flows from gas supply 200 through pressure controller 202 and into gas purifier 204. Gas purifier 204 further purifies the gas mix received from the gas supply 200 by removing, among other contaminants, water vapor and oxygen from the gas mix. In one example, to provide a high purity gas supply, gas purifier 204 is capable of purification to the part per billion (ppb) oxygen and moisture level. After passing through the gas purifier 204, the gas mix flows into the inlet of the vessel 104 of the target material deoxidation system 100.

The gas outlet, e.g., one end of the gas exhaust tube 114, of the vessel 104 of the target material deoxidation system 100 is coupled to the exhaust gas network 118. The exhaust gas network 118 includes, among other components, flow controller 206 and spectrometer 208. The exhaust gas network 118 can also include components that provide protection from the back diffusion of oxygen. Flow controller 206 includes components for controlling gas flow rates of the exhaust gas. Spectrometer 208 is used to monitor the water vapor in the exhaust gas exiting the vessel 104 of the target material deoxidation system 100. In one example, spectrometer 208 is a cavity ring-down spectrometer (CRDS) with a detection limit in the ppb range. As hydrogen entering the vessel 104 of the deoxidation system 100 reacts with oxygen contained in the target material, e.g., tin, water vapor is formed and removed from the vessel by the continuous flow of the gas mix. As such the water vapor concentration in the exhaust gas correlates with the concentration of oxygen that is still present in the molten target material. As will be described in more detail later, when the signal from the spectrometer, e.g., a CRDS, reaches a steady state, this indicates that deoxidation of the target material is complete and the reaction can be stopped.

With continuing reference to FIG. 2, port 104*a* of vessel 104 is used to communicate molecular flow from the vessel to vacuum system 120. In one example, one end of port 104*a* is located outside of the vessel 104 and the other end is in flow communication with the inside of the vessel. To achieve a sufficient vacuum within the vessel 104, seals with excellent performance at elevated temperatures are used. By way of example, seals with a coefficient of thermal expansion substantially matching that of the vessel material may be used. Vacuum conductance between the vessel 104 and the vacuum system 120 is achieved by a valve that can hold acceptable vacuum levels and internal pressure levels.

Vacuum system 120 includes, among other components, components for achieving, monitoring, and controlling vacuum to $10^{-7}$ torr levels. In one example, the vacuum system 120 includes at least one vacuum generating device capable of generating high vacuum. As used herein, the term "high vacuum" refers to a vacuum of at least $10^{-5}$ torr. In one example, the high vacuum is $10^{-7}$ torr or better. In one example, the vacuum generating device used to generate a high vacuum is a turbomolecular pump 210. A scroll pump can be used to backup the turbomolecular pump. Gauges 212 are used to measure vacuum levels and a controller suspends temperature ramping of the heaters (e.g., heaters 106 shown in FIG. 1) if residual gas species exceed predetermined limits. A residual gas analyzer (RGA) 214 is used to monitor partial pressures of trace gas species at different stages of the process as well for leak testing.

Figure 3:
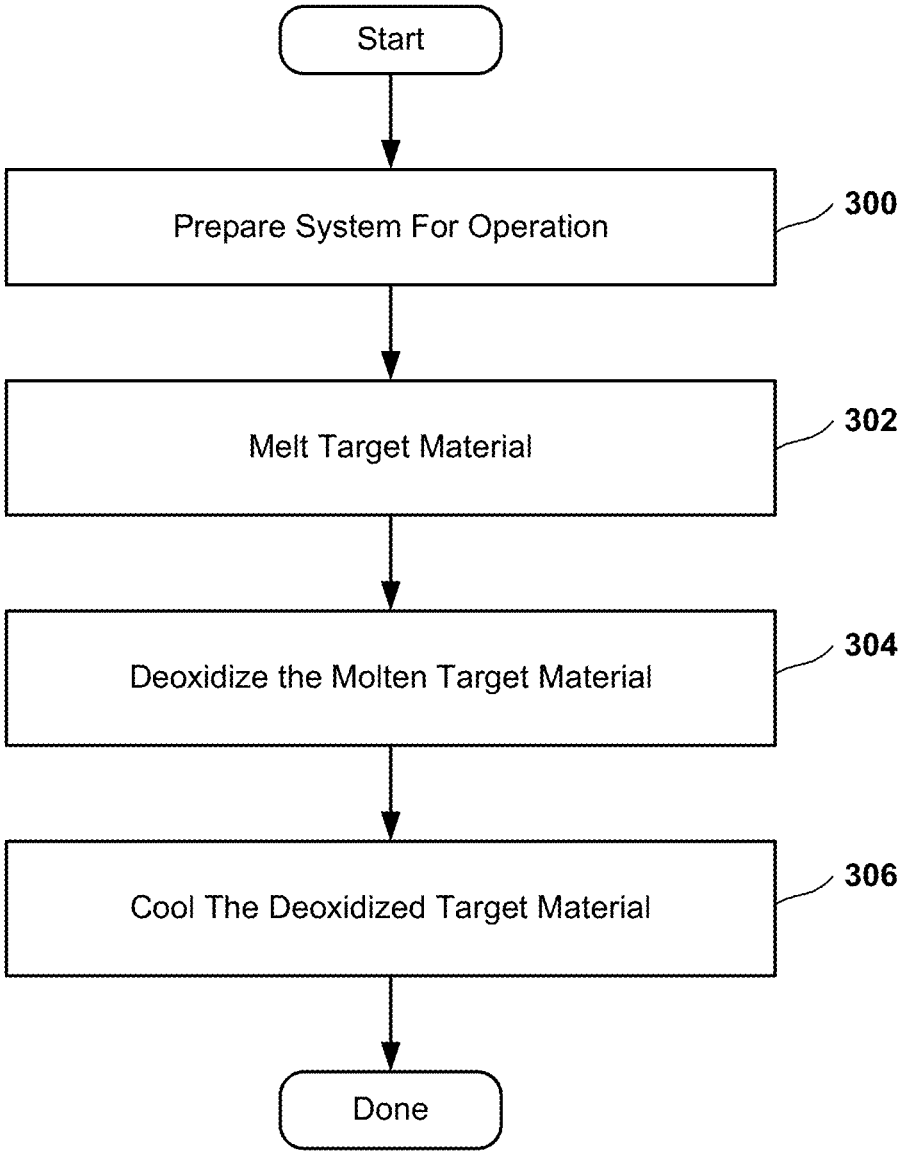
FIG. 3 is a flowchart diagram illustrating the method operations performed in purifying a target material, in accordance with an example embodiment.

FIG. 3 is a flowchart diagram illustrating the method operations performed in purifying a target material, in accordance with an example embodiment. In operation 300, the target material deoxidation system is prepared for the purification operation. The preparation operation can include preparing the gas lines connected to the gas mix, e.g., pure $H_2$ or an $Ar/H_2$ gas mix. In one example, the gas lines are baked out, purged with pure inert gas (with the pure inert gas being free of oxygen and water vapor), and sealed. In addition, new consumable seals, gaskets, and related hardware that are needed to seal the vessel and connect the gas, exhaust, and vacuum tubing are obtained. The crucible to be used in the purification process is also inspected to confirm that is clean (to avoid the introduction of impurities) and free from any cracks or other signs of damage.

The preparation operation further includes loading the target material into a crucible. In the example in which the target material is tin, the as-received tin typically comes in the form of cylindrical rods or bars. In one example, several rods of tin are loaded into a quartz crucible. Once the tin is loaded into the crucible, the crucible is slid into a vessel and the vessel is sealed. In one example, a metal sled is used to slide the crucible into the vessel to protect the crucible from abrasion. The sealed vessel is then installed in a furnace so that the vessel and its contents can be heated, as will be described in more detail below.

In operation 302, the target material is melted. The melting operation includes generating a vacuum within the vessel and heating once seal integrity is determined. The vessel can be pumped down using a suitable pump or combination of pumps. In one example, the vessel is pumped down first with a scroll pump (to provide an approximately 100 mtorr vacuum) and then with a turbomolecular pump to $10^{-7}$ torr vacuum. Once an effective high vacuum condition is reached within the vessel, the heater (or heaters) of the furnace can be started. In one example, the heater temperature is ramped up from room temperature to 500 degrees C. in about one hour. The temperature of 500 degrees C. is maintained until the target material melts. In the case where the target material is tin, it typically takes 30 minutes to one hour for the tin to melt, depending upon the amount of tin loaded into the crucible. During this process, the residual gas analyzer (RGA) will show spikes to indicate the release of trapped or dissolved gases. When the RGA stops detecting gas release, the tin is considered to be fully melted and the appropriate valve(s) between the vacuum pump (scroll pump/turbomolecular pump) and the vessel can be closed. Once the appropriate valve (or valves) to the vacuum pump has been closed, the method can proceed to the next operation.

In operation 304, the molten target material is deoxidized. In one example, the molten target material is deoxidized by flowing hydrogen over the surface of the molten target material. This can be accomplished by introducing pure hydrogen or a gas mix containing hydrogen into the vessel in a manner that facilitates reaction between the hydrogen/gas mix and the molted target material. In one example, the gas mix includes no more than 2.93 molar % of hydrogen and the balance is substantially argon. (As previously discussed, a gas mix having a relatively low concentration of hydrogen may be selected for safety reasons because such a gas mix is nonflammable.) To increase the free surface area of the molten target material over which the gas mix is flowing, the crucible can be oriented at an angle, e.g., about 10 degrees to about 15 degrees, relative to the horizontal plane. In one example, the crucible is oriented at an angle of about 12 degrees relative to the horizontal plane as the gas mix flows over the free surface of the molten target material in the crucible.

The gas mix containing hydrogen is introduced into the reaction vessel at a preset pressure and flow rate. In one example, the pressure is about 60 psi and the flow rate is about one standard liter per minute. Those skilled in the art will appreciate that pressure of the gas mix can be varied, e.g., from about one atmosphere (14.5 psi) to about 200 psi, to suit the needs of particular applications. By introducing the gas mix at higher pressure, the rate of the deoxidation process can be increased. Moreover, maintaining the vessel at higher pressure helps to minimize the rate at which oxygen and water vapor enter the vessel through gas leaks present in the vessel. The flow rate, which is proportional to the amount of tin being processed, also can be varied to suit the needs of particular applications. For example, a flow rate of about 10 liters per minute may be sufficient in many instances, but, if necessary, the flow rate could be increased. After the gas mix begins flowing over the surface of the molten tin, the heater temperature is increased from 500 degrees C. to 750 degrees C. Once equilibrium is established at 750 degrees C. with the gas mix flowing over the molten tin, the system is left to operate in this state for a predetermined period of time.

As the deoxidation reaction proceeds at steady-state operation, the purity of the target material is inferred by measuring the concentration of the water vapor in the gas exiting the reaction vessel. In one example, the concentration of the water vapor in the exiting gas is measured using a spectrometer. In a specific example, a cavity ring-down spectrometer (CRDS) with a detection limit in the ppb range is used. When the measurement of the concentration of the water vapor begins, it has been observed that the concentration of water vapor in the exiting gas increases up to 20 ppm. Thereafter, the water vapor concentration in the exiting gas gradually decays, approximately exponentially, to about 100 ppb and stabilizes at this level. Those skilled in the art will appreciate that measuring the water vapor concentration in the exiting gas is an indirect method of measuring the concentration of oxygen in the molten target material. The observed water vapor concentration of about 100 ppb in the exiting gas is believed to be an inherent minimum for the system and no further meaningful reduction can occur.

Once the measured concentration of water vapor in the gas exiting from the vessel decays to a minimum, the deoxidation of the molten tin is considered to be complete. It has been observed that it typically takes about 20 hours for the measured concentration of the water vapor in the exiting gas to remain near the above-mentioned level of 100 ppb.

In some applications, it might not be necessary to allow the deoxidation reaction to proceed until a minimum water vapor concentration is reached. Thus, the deoxidation reaction can be stopped when the measured concentration of water vapor in the gas exiting the vessel reaches a target condition. In one example, the target condition includes the measured water vapor concentration stabilizing at a minimum level, e.g., about 100 ppb as described above in the case where the target material is tin. In other examples, the target condition is reached before measured water vapor concentration stabilizes at the minimum level. In one such example, the target condition indicates a predetermined concentration of oxygen in the target material. In another example, the target condition indicates a predetermined concentration of oxygen in the target material that is less than a multiple of a solubility limit of oxygen in the molten target material. The multiple of the solubility limit of oxygen in the molten target material can be selected based on the purity level needed in the deoxidized target material. By way of example, the multiple can be about 100 times the solubility limit of oxygen in the molten target material, about 10 times the solubility limit, about 1.5 times the solubility limit, or any multiple therebetween. For a frame of reference, as described above, commercially pure tin contains oxygen at a concentration that is at least about 1,000 times the solubility limit of oxygen just above the melting point of tin.

In the case where the target material is tin, the solubility limit of oxygen in molten tin is in the range of 1 part per billion (ppb). Using the above-described multiples of the solubility limit, the oxygen concentration in commercially pure tin is no less than about 1,000 ppb, which is greater than 1 part per million (ppm). In contrast, using the deoxidation method described herein, ultra-high purity tin having an oxygen concentration level from less than 1 ppb to about 20 ppb can be achieved.

In operation 306, the deoxidized target material is cooled. In one example, the heaters are turned off while the flow of the hydrogen-containing gas is maintained. During the cooling process, the effectiveness of hydrogen reduction decreases and significant surface oxidation of the deoxidized target material, e.g., tin, can occur if the material is not protected from oxygen. By maintaining positive pressure and flow during the cooling process, the intake of oxygen and water vapor into the vessel through any leaks that invariably occur in practical systems is minimized.

With the heaters turned off, the vessel is allowed to cool naturally from about 750 degrees C. down to about 50 degrees C. To reduce the cycle time, forced cooling may be used to cool the vessel. In one example, the forced cooling is implemented using air; however, those skilled in the art will appreciate that other suitable high temperature compatible cooling fluids also can be used. Once the temperature of the vessel cools down to roughly room temperature (e.g., less than about 50 degrees C.), the flow of the gas containing hydrogen is stopped and the vessel is depressurized.

Once the vessel has been depressurized, the closure device is removed from the vessel. Thereafter, the crucible is removed from the vessel. In one example, a stainless steel sheet metal sled is provided to facilitate removal of the crucible from the vessel. By pulling on the metal sled, the crucible can be slid out of the vessel. To remove the ingot of target material from the crucible, the crucible can be placed on a suitable unloading pad and slowly tilted until the ingot slides out of the crucible and onto the unloading pad. Once removed from the crucible, the deoxidized ingots of target material can be stored for later use, e.g., in the droplet generator of an EUV light source. To minimize oxidation while in storage, the deoxidized ingots can be stored in, for example, a vacuum or inert gas environment. In one example, the deoxidized ingots are stored in vacuum bags.

In the example shown in FIG. 1, the gas input tube 112 and the gas exhaust tube 114 pass through openings in the closure device 110. It should be understood that the gas input tube 112 and the gas exhaust tube 114 also can pass through a sidewall or a closed end of the vessel 104. Further, the vessel 104 can have two open ends rather than just one open end as shown in FIG. 1. In this example, a suitable closure device, e.g., closure device 110, would be secured to each of the two open ends of the vessel 104. Still further, in the example of FIG. 1, port 104*a* is defined in a sidewall of the vessel 104. It should be understood that a vacuum port also can be defined in either a closure device secured to an open end of the vessel or a closed end of the vessel.

In the examples described herein, a single vessel is used in the furnace. It should be understood that a larger furnace that is capable of heating multiple vessels also can be used. In this manner, multiple loads of target material can be processed at the same time. For example, the larger furnace may have a larger internal diameter and may be longer. In such a furnace, several crucibles can be introduced at the same time by using a special fixture. To keep the duration of the deoxidation process roughly the same as in the case of a single crucible, the flow of either pure hydrogen or a hydrogen/argon gas mix would need to be increased relative to the flow used for the single crucible.

In the examples described herein, the target material is high purity tin. Those skilled in the art will appreciate that the method described herein also might be useful to deoxidize other metals.

Accordingly, the disclosure of the example embodiments is intended to be illustrative, but not limiting, of the scope of the disclosures, which are set forth in the following claims and their equivalents. Although example embodiments of the disclosures have been described in some detail for purposes of clarity of understanding, it will be apparent that certain changes and modifications can be practiced within the scope of the following claims. In the following claims, elements and/or steps do not imply any particular order of operation, unless explicitly stated in the claims or implicitly required by the disclosure.

What is claimed is:

1. A system, comprising:

a furnace having a central region defined therein and at least one heater configured to heat the central region in a substantially uniform manner;

a vessel having an open end for loading a target material, such that when inserted in the central region of the furnace, the open end of the vessel is located outside of the furnace;

a crucible having an open end disposed within the vessel, the crucible being disposed within the vessel such that the open end of the crucible faces the open end of the vessel;

a closure device covering the open end of the vessel, the closure device configured to form a seal having vacuum and pressure capability;

a gas input tube having a first end located outside the vessel and a second end located inside the vessel, the second end of the gas input tube being positioned such that an input gas flowing into the vessel through the input tube is directed into the crucible;

a gas exhaust tube having a first end located outside the vessel and a second end in flow communication with an inside of the vessel;

a vacuum port having a first end located outside the vessel and a second end in flow communication with the inside of the vessel;

a gas supply network coupled in flow communication with the first end of the gas input tube;

a gas exhaust network coupled in flow communication with the first end of the gas exhaust tube; and a vacuum network coupled in flow communication with the first end of the vacuum port.

2. The system of claim 1, wherein the vessel is a metal vessel.

3. The system of claim 2, wherein the metal vessel is comprised of stainless steel or an alloy steel.

4. The system of claim 2, wherein an outer surface of the vessel is coated with an oxidation-resistant material.

5. The system of claim 1, wherein the gas supply network comprises a gas supply containing hydrogen and a gas purifier.

6. The system of claim 5, wherein the gas supply contains a gas mixture of argon and hydrogen.

7. The system of claim 6, wherein the gas mixture of argon and hydrogen includes up to 2.93 molar % hydrogen and the balance substantially argon.

8. The system of claim 1, wherein the gas exhaust network comprises at least one flow controller and a cavity ring-down spectrometer (CRDS).

9. The system of claim 1, wherein the vacuum network comprises at least one vacuum generating device capable of generating high vacuum and at least one vacuum gauge.

10. The apparatus as claimed in claim 1, wherein in use the crucible is rotated with respect to horizontal.

11. The apparatus as claimed in claim 1, wherein in use the crucible is rotated about 12 degrees with respect to horizontal.

12. An apparatus adapted to purify target material, the apparatus comprising:

a furnace having a central region defined therein and at least one heater configured to heat the central region in a substantially uniform manner; a vessel having an open end for loading, such that when inserted in the central region of the furnace, the open end of the vessel is located outside of the furnace;

a crucible disposed within the metal vessel, the crucible having an open end and a closed end, the crucible disposed within the metal vessel such that the open end of the crucible faces the open end of the metal vessel, a sidewall of the crucible having a tapered shape that facilitates removal of an ingot of the target material from the crucible;

a closure device covering the open end of the metal vessel, the closure device configured to form a seal having vacuum and pressure capability;

an input tube having a first end located outside the vessel and a second end located inside the vessel, the second end of the input tube being positioned to direct an input gas flowing into the vessel through the input tube toward the crucible; and an exhaust tube having a first end located outside the metal vessel and a second end in flow communication with the inside of the metal vessel.

13. The apparatus of claim 12, wherein the crucible is a quartz crucible purified and cleaned to a level compatible with compound semiconductor crystal growth.

14. The apparatus of claim 12, wherein the crucible is comprised of carbon coated quartz, glassy carbon, graphite, glassy carbon coated graphite, or SiC-coated graphite.

15. The apparatus of claim 12, wherein the input tube is a metal tube or a glass tube.

16. The apparatus of claim 12, wherein the input tube is a ceramic tube or a graphite tube.

17. The apparatus of claim 12, further comprising:

a vacuum port defined in a wall of the metal vessel.

* * * * *